US006007104A

United States Patent [19]

Draper

[11] Patent Number: 6,007,104

[45] Date of Patent: Dec. 28, 1999

[54] COMBINED MEDICAL DEVICE AND FORM

[76] Inventor: Brad E. Draper, 933 W. 42nd St., Kansas City, Mo. 64111

[21] Appl. No.: 09/090,371

[22] Filed: Jun. 4, 1998

[51] Int. Cl.[6] ..... B42D 15/00

[52] U.S. Cl. ..... 283/74; 283/79; 283/900; 283/61

[58] Field of Search ..... 283/900, 105, 283/101, 61, 62, 74, 75; 462/22, 24, 28

[56] References Cited

U.S. PATENT DOCUMENTS

| | | | |
|---|---|---|---|
| 5,803,498 | 9/1998 | Tung et al. | 283/56 |
| 5,855,395 | 1/1999 | Foote et al. | 283/67 |
| 5,895,075 | 4/1999 | Edwards et al. | 283/81 |
| 5,908,208 | 6/1999 | Lapsker | 283/56 |

OTHER PUBLICATIONS

FTA GeneCard.
FTA Enclosed Gene Card.
Neonatal Screening Form (Division of Health and Environmental Laboratories).

*Primary Examiner*—Willmon Fridie, Jr.
*Attorney, Agent, or Firm*—Hovey, Williams, Timmons & Collins

[57] ABSTRACT

A combined medical device and form (20) having a unitary substrate (22) which is divided into a medical device portion (24) and a form portion (26). The form portion (24) of the substrate includes an informational section (30, 32, 34), and form identification material (36). The medical device portion (26) is illustrated as a DBS packet for collecting blood samples. The medical device portion (26) also has medical device identification material (68) that is preferably identical to the form identification material (36). With identical identification materials, which are preferably machine readable, the occurrences of patient misidentifications are substantially reduced if not eliminated.

20 Claims, 1 Drawing Sheet

COMBINED MEDICAL DEVICE AND FORM

COPYRIGHT NOTICE AND AUTHORIZATION

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

This invention relates to medical devices with accompanying forms and, more particularly, to combined medical devices and forms.

Every year millions of biological specimens are taken from test subjects for various purposes including HIV testing, insurance qualification, diabetic monitoring, infant blood screening, etc. It is critically important for all types of blood testing that the specimens are properly identified with the correct test subject, yet misidentifications occur all too frequently. Misidentifications are extremely difficult to find and often go undiscovered, and when one is found, another test must be performed.

Using infant blood screening as an example, dry blood spot (DBS) packets, which are considered medical devices by the FDA, are frequently used to take blood specimens. A medical care giver records necessary biographical information about an infant on at least one form and pricks the infant, usually on the heel. The medical care giver then applies blood from the prick to fill a plurality of designated circular areas on an absorbing blood application sheet of the DBS packet. To try and prevent misidentifications, the medical care giver applies duplicate identification stickers to the form and to the DBS packet. The DBS packet and the accompanying form are returned to a test lab for processing. All to frequently, the wrong stickers are applied to the form and DBS packet. Because the form is independent of the DBS packet, it is now impossible to properly match the specimen and the infant thus, requiring retesting.

If the blood screening of the tested infant reveals a need for further procedure or testing, the wrong infant may receive such procedure because the identification stickers were misapplied. Further, the infant needing the procedure may not receive it until additional symptoms are manifested. Clearly, even one misidentification is unacceptable.

The scope of the misidentification problem is not limited to infant blood screening. Misidentifications can and do occur in other contexts, and because the forms are independent of the packets and are numbered at different times during the production process, these misidentifications are also nearly impossible to find prior to specimen collection.

A problem encountered, specific to DBS packets, is contamination. A large majority of the rear of a DBS packet is left open, so that blood applied to the circular areas can dry. Thus, when the packet is set on a surface, the blood application sheet contacts that surface potentially contaminating the sample, and contamination leads to expensive and unnecessary retesting.

Thus, reducing the chances of contamination is desirable to avoid retests and associated costs. Further, reducing occurrences of misidentifications is desirable to enhance the quality of medical care and reduce the number of retests thereby cutting medical costs. It is also desirable to reduce the application of identification stickers by medical care givers to save time, increase identification accuracy, and reduce cost.

BRIEF SUMMARY OF THE INVENTION

There is, therefore, provided in the practice of the invention a novel combined medical device and form, which reduces the occurrences of patient misidentification for biological specimen samples. The combined medical device and form includes a unitary substrate bifurcated into a form portion and a medical device portion. Each portion has identification material printed thereon for matching the form portion with the medical device portion.

In a preferred embodiment, a separation line, in the form of a line of weakness, divides the form portion from the medical device portion. The form portion includes an informational section containing insurance, patient, and instructional information. The identification materials printed on the form and medical device portions are preferably machine readable bar codes which are substantially identical and printed simultaneously.

There is further provided in the practice of the invention a novel medical testing apparatus including a unitary substrate having a form portion and a medical device portion. The form portion includes form identification material, and the medical device portion includes medical device identification material. A medical device is secured to the medical device portion of the substrate.

In a preferred embodiment, a perforated separation line divides the form portion from the medical device portion. A securement sheet having a pressure sensitive adhesive secures the medical device to the substrate, and the securement sheet has a perimeter extended beyond the medical device.

There is still further provided in the practice of the invention a novel dry blood spot testing apparatus including a substrate having at least one blood application opening and a blood application sheet secured to the substrate. Preferably the blood application sheet is secured to the substrate with a securement sheet having a pressure sensitive adhesive. The securement sheet also has at least one blood application opening which is aligned with the blood application opening in the substrate. A back cover sheet is also preferably provided for selectively covering the blood application openings. Further, the substrate is preferably bifurcated into a form portion and a medical device portion bifurcated by a separation line.

Accordingly, it is an object of the present invention to provide an improved combined medical device and form for reducing the occurrences of patient misidentification.

It is a further object of the present invention to provide an improved medical testing apparatus for reducing the occurrences of patient misidentification.

It is a still further object of the present invention to provide an improved dry blood spot testing apparatus which reduces contamination.

BRIEF DESCRIPTION OF THE DRAWINGS

These and other inventive features, advantages, and objects will appear from the following Detailed Description of The Preferred Embodiments when considered in connection with the accompanying drawings in which similar reference characters denote similar elements throughout the several views and wherein.

DETAILED DESCRIPTION OF THE PREFERRED EMBODIMENTS

Figure 1:
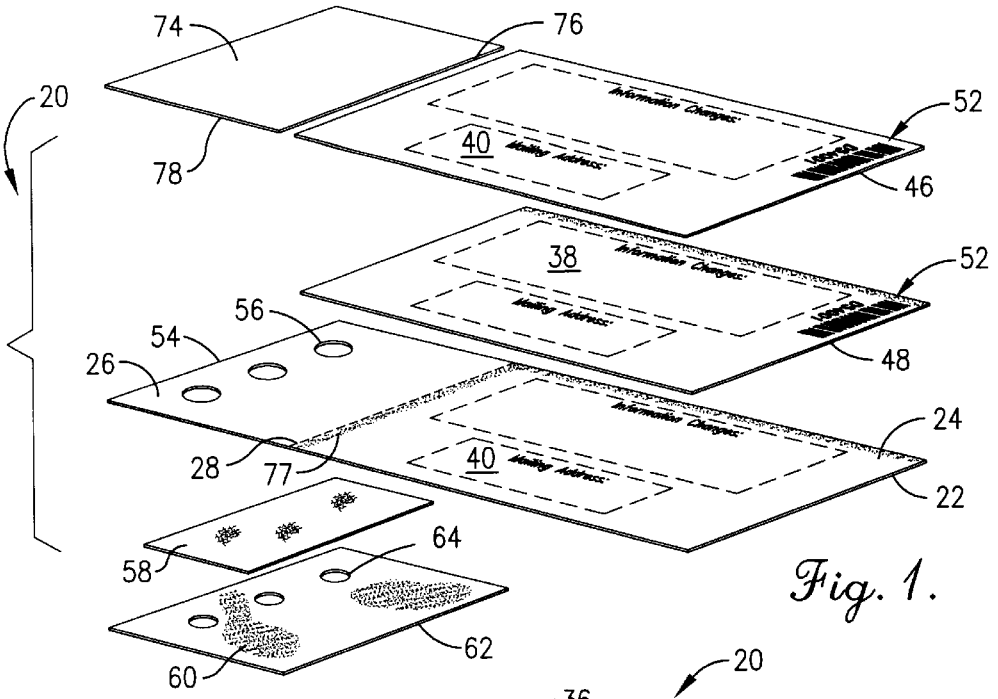
FIG. 1 is an exploded view of a combined medical device and form according to the present invention.
Figure 2:
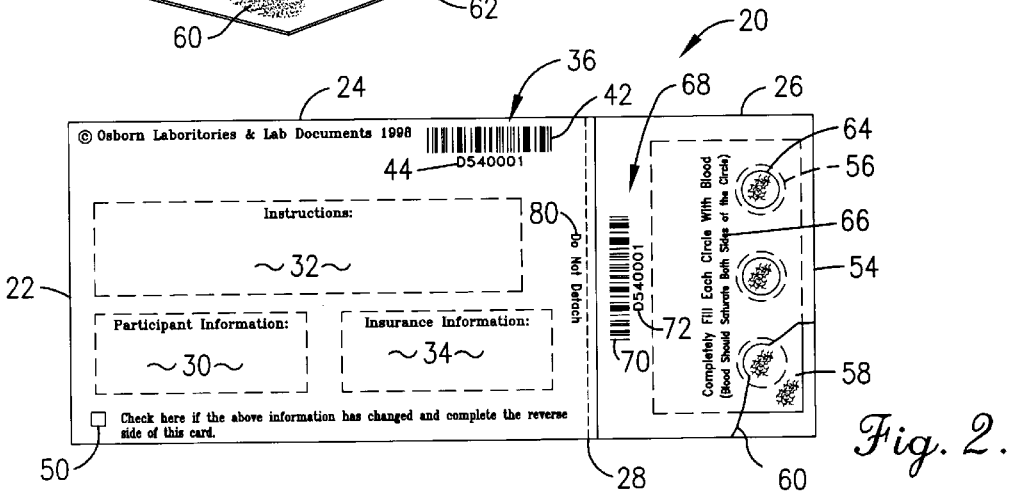
FIG. 2 is front elevational view of the combined medical device and form of FIG. 1 having a corner of an adhesive paper removed for illustration.
Figure 3:
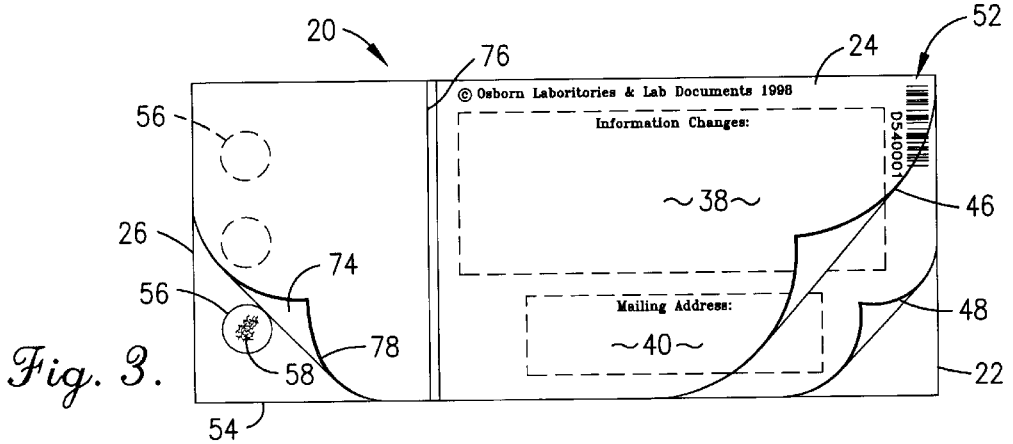
FIG. 3 is a back elevational view of the combined medical device and form of FIG. 1 having a corner of each layer turned up for illustration.

Referring to the drawings in greater detail, FIGS. 1 through 3 show a combined medical device and form, generally designated 20, having a unitary substrate 22. The substrate is divided into a form portion 24 and a medical device portion 26 with a separation line 28 between the form portion 24 and the medical device portion 26. Because the medical device and form are attached and the bar codes are printed simultaneously, the chances of a misidentification are substantially reduced if not eliminated.

The substrate 22 is substantially flat and preferably constructed with heavyweight paper or paperboard. The form portion 24 of the substrate 22 includes a biographical data section 30, an instruction section 32, an insurance information section 34, form identification material 36, a biographical data entry/update section 38, and a mailing information section 40.

The biographical data section 30 is printed directly onto the front of the substrate and includes necessary participant information such as name and address and can be preprinted for continuous blood monitoring programs. The instruction section 32 is also printed on the front of the substrate. The instruction section includes appropriate instructions for the attached medical device. If the attached medical device is a DBS packet as illustrated, the instructions would include, for example, (1) Rinse hands in warm tap water; (2) Select puncture site and wipe area with alcohol swab; (3) Puncture site with lancet; (4) Place blood drops on three circles on the front side of this card; (5) Let card dry 30 minutes; and (6) Insert card into return envelope and place in U.S. Mail. © Osborn Laboratories 1998

The insurance information section 34 is printed on the front of the substrate 22. The insurance information section 34 and biographical data section 30 are positioned beside each other and below the instruction section 32. The insurance information section contains necessary insurance information such as insurance company name, policy numbers, and doctor's name. The instructions, biographical data, and insurance information together form an informational section on the front of the substrate 22.

The form identification material 36 is printed directly on the front of the substrate 22 preferably above the instruction section 32 and adjacent to the line of separation 28. The form identification material 36 preferably comprises a machine readable bar code 42 and an identification number 44. The machine readable bar code and identification number specifically identify the biographical data, insurance information, and instructions printed on the substrate. Thus, the identification material 36 also identifies the type of medical device.

The biographical data update section 38 is printed on the back of the substrate 22, on an upper carbon copy 46, and a lower carbon copy 48. When the participant needs to change any information printed on the front of the substrate, the participant checks a box 50 FIG. 2) on the front of the substrate 22 and completes the biographical data update section 38 to change the information corresponding to the form identification material 36. The updated information is printed on the upper carbon copy 46 and is also printed through to the lower carbon copy 48 and the substrate 22. Each of the carbon copies 46, 48 preferably include identification material 52 printed on their outer faces. The carbon copy identification material 52 corresponds to the form identification material 36 and is preferably substantially identical thereto.

The mailing information section 40 is also printed on the back of the substrate 22. The mailing information section includes the address where the combined form and medical device 20 is to be returned for processing. The mailing information section is preferably positioned below the biographical data update section 38 and is also printed on the upper and lower carbon copies 46, 48.

The medical device portion 26 of the substrate 22 includes, using a DBS packet as an example, a perimeter 54 and a plurality of blood application openings 56. There are preferably three blood application openings 56. A blood application sheet 58 is secured to the front of the substrate 22 by a securement sheet 60. The securement sheet 60 preferably includes a pressure sensitive adhesive and has a perimeter 62 which surrounds the blood application sheet, so that all edges of the blood application sheet are secured to the substrate. The perimeter 62 of the securement sheet 60 preferably coincides with at least the three unattached sides of the perimeter 54 of the medical device portion 26. The securement sheet 60 also includes three blood application openings 64 which are aligned with the blood application openings 56 of the substrate 22 to expose both sides of the blood application sheet 58. The blood application openings 56 of the substrate 22 are preferably larger than the blood application openings 64 of the securement sheet 60 to assure alignment in an automated assembly process, and the openings 56 are further sized to allow blood to dry in the blood application sheet 58 while inhibiting contact between the blood application sheet 58 and any surface on which the DBS packet rests. Thus, the small openings inhibit contamination.

Further instructions 66, are preferably printed adjacent to the blood application openings 64 on the securement sheet 60, and medical device identification material 68 is preferably printed on the outer/front face of the securement sheet 60. The medical device identification material 68 can also be printed directly onto the medical device portion 26 of the substrate 22. The medical device identification material 68 corresponds to the form identification material 36 of the attached form portion 24. Preferably, the medical device identification material 68 is substantially identical to the form identification material 36 and the carbon copy identification material 52. The medical device identification material 68 also includes a machine readable bar code 70 and an identification number 72. With the identification material printed on the various components, and with the unitary substrate, it is possible to obtain 100% verification of test subject identities.

The medical device portion 26 also includes a back cover sheet 74 having an inner edge 76 attached with an adhesive 77 to the back of the substrate adjacent to the line of separation 28 preferably on the form side of the line of separation 28. The back cover sheet 74 is preferably a flexible sheet of water, oil, and grease resistant paper which can be obtained from Nationwide Paper at 1445 Saline, North Kansas City, Mo. 64116 by requesting 50# WOGR. Alternatively, wax paper, which is resistant to moisture penetration can be used. The perimeter 78 of the back cover sheet preferably substantially coincides with the perimeter 54 of the substrate but is at a minimum large enough cover the blood application openings 56 in the substrate. The back cover sheet selectively covers the blood application openings in the substrate to protect the blood application sheet 58 from contamination during blood application while permitting the blood application sheet to dry from both the front and back.

The line of separation 28 is a line of weakness extending from one edge of the substrate to an opposite edge of the substrate across the narrow dimension of the preferably rectangular substrate. The line of weakness preferably comprises a perforated line. Further, the instructions "Do Not Detach" 80 are printed adjacent to the perforated line on the form side thereof In operation, the combined medical device and form is provided to phlebotomist and/or participants for use. After use, the combined medical device and form is returned to the mailing address in the mailing information section 40 for processing with the medical device and form still connected. The mailing address is typically a laboratory which will separate the form and medical device, enter any updated information, and process the sample contained by the blood application sheet 58. Because the back cover sheet 74 is attached to the form side of the perforation line 28, the DBS packet is removed from the form portion 24 without the back cover sheet thereby simplifying laboratory processing.

The combined medical device and form 20 according to the present invention provides a medical device which substantially reduces if not eliminates the occurrences of misidentification of biological test samples such as blood provided on DBS packets. Further, the combined medical device and form provides a 100% valid chain of custody. The medical device, form, and carbon copies of updated information all contain the identical identification material, so that by use of the identification numbers or bar codes, all pertinent information can be immediately and accurately accessed.

Thus, a combined medical device and form is disclosed which utilizes a unitary substrate having a medical device portion and a form portion to obtain biological specimen samples thereby nearly, if not completely, eliminating the occurrences of misidentifications. While preferred embodiments and particular applications of this invention have been shown and described, it is apparent to those skilled in the art that many other modifications and applications of this invention are possible without departing from the inventive concepts herein. It is, therefore, to be understood that, within the scope of the appended claims, this invention may be practiced otherwise than as specifically described, and the invention is not to be restricted except in the spirit of the appended claims. Though some of the features of the invention may be claimed in dependency, each feature has merit if used independently.

What is claimed is:

1. A combined medical device and form comprising:

a unitary substrate having a form portion and a medical device portion;

a biographical data section on the form portion of the substrate;

form identification material on the form portion of the substrate;

medical device identification material on the medical device portion, and the medical device identification material corresponding to the form identification material for matching the form with the medical device; and a separation line dividing the form portion from the medical device portion, and the separation line being positioned between the form identification material and the medical device identification material.

2. The combined medical device and form according to claim 1 wherein the substrate comprises a paper board substrate.

3. The combined medical device and form according to claim 1 wherein the biographical data section comprises a data update section.

4. The combined medical device and form according to claim 3 further comprising a plurality of carbon copy sheets operatively disposed relative to the data update section to create multiple copies of updated biographical data.

5. The combined medical device and form according to claim 4 wherein each carbon copy includes carbon copy identification material substantially identical to the form identification material.

6. The combined medical device and form according to claim 1 wherein the form identification material comprises machine readable bar code, and the medical device identification material comprises a substantially identical machine readable bar code.

7. The combined medical device and form according to claim 1 wherein the separation line comprises a line of weakness for separating the medical device from the form.

8. The combined medical device and form according to claim 1 wherein the medical device is secured to the medical device portion of the substrate.

9. The combined medical device and form according to claim 1 further comprising an informational section including test instructions.

10. A medical testing apparatus comprising:

a unitary substrate having a form portion and a medical device portion;

a biographical data section located on the form portion of the substrate;

form identification material on the form portion of the substrate;

medical device identification material on the medical device portion, and the medical device identification material corresponding to the form identification material for matching the form with the medical device;

a separation line dividing the form portion from the medical device portion, and the separation line being positioned between the form identification material and the medical device identification material; and a medical device secured to the medical device portion of the substrate.

11. The testing apparatus according to claim 10 wherein the medical device comprises a DBS packet.

12. The testing apparatus according to claim 10 wherein the line of separation comprises a perforated line of weakness.

13. The testing apparatus according to claim 10 further comprising a securement sheet having pressure sensitive adhesive securing the medical device to the medical device portion of the substrate.

14. The testing apparatus according to claim 13 wherein the securement sheet comprises a perimeter margin extending beyond the medical device and adhering to the medical device portion of the substrate.

15. The testing apparatus according to claim 10 wherein the biographical data section comprises a data entry section.

16. A dry blood spot testing apparatus comprising:

a substrate having at least one blood application opening; and a blood application sheet secured to the substrate, and the blood application sheet covering the at least one blood application opening.

17. The testing apparatus according to claim 15 further comprising a securement sheet adhering to the substrate and the blood application sheet.

18. The testing apparatus according to claim 16 wherein the securement sheet comprises a plurality of blood application openings, and the substrate comprises a plurality of blood application openings aligned with the blood application openings in the securement sheet.

19. The testing apparatus according to claim 16 wherein the securement sheet includes a pressure sensitive adhesive and a perimeter surrounding the blood application sheet.

20. The testing apparatus according to claim 15 wherein the substrate includes a form portion and medical device portion separated by a separation line.

* * * * *

UNITED STATES PATENT AND TRADEMARK OFFICE

CERTIFICATE OF CORRECTION

PATENT NO : 6,007,104

DATED : December 28, 1999

INVENTOR(S) : Brad E. Draper

It is certified that error appears in the above-identified patent and that said Letters Patent is hereby corrected as shown below:

Column 7, line 1, delete "15" and insert --16-- therefor.

Column 7, line 4, delete "16" and insert --17-- therefor.

Column 8, line 1, delete "16" and insert --17-- therefor.

Column 8, line 4, delete "15" and insert --16-- therefor.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*